US010020614B1

(12) United States Patent
Bucher

(10) Patent No.: US 10,020,614 B1
(45) Date of Patent: Jul. 10, 2018

(54) PLUGGABLE MODULE HAVING A LATCH

(71) Applicant: TE CONNECTIVITY CORPORATION, Berwyn, PA (US)

(72) Inventor: Alan Weir Bucher, Manheim, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/487,912

(22) Filed: Apr. 14, 2017

(51) Int. Cl.
*H01R 13/627* (2006.01)
*H01R 13/633* (2006.01)

(52) U.S. Cl.
CPC ..... *H01R 13/6271* (2013.01); *H01R 13/6335* (2013.01)

(58) Field of Classification Search
CPC ..... H01R 13/6272; H01R 13/6275
USPC ..... 439/352, 159
See application file for complete search history.

(56) References Cited

U.S. PATENT DOCUMENTS 4,621,885 A 11/1986 Szczesny et al.
5,741,150 A 4/1998 Stinson et al.
7,064,959 B2 6/2006 Kim
7,083,459 B1 8/2006 Wu et al.
7,114,980 B1 * 10/2006 Wu ..... H01R 13/6275 439/352
7,147,502 B1 * 12/2006 Wu ..... H01R 13/6275 439/352
7,163,413 B2 * 1/2007 Murayama ..... H01R 13/6272 439/258
7,322,845 B2 * 1/2008 Regnier ..... H01R 13/6335 439/352
7,402,070 B1 * 7/2008 Wu ..... H01R 13/635 439/152
7,422,457 B1 * 9/2008 Wu ..... G02B 6/4201 439/258
7,422,471 B1 * 9/2008 Wu ..... H01R 13/6658 439/485
7,429,185 B1 * 9/2008 Wu ..... H01R 13/6275 439/372
7,507,103 B1 * 3/2009 Phillips ..... G02B 6/4201 439/352
7,559,785 B1 * 7/2009 Wu ..... H01R 13/6275 439/352
7,938,669 B2 * 5/2011 Li ..... H01R 13/6275 439/352

(Continued)

OTHER PUBLICATIONS

International Search Report dated Jun. 15, 2016 received in International Application No. PCT/US2016/024613.

*Primary Examiner* — Gary Paumen

(57) ABSTRACT

A pluggable module includes a pluggable body having a top wall, a bottom wall and side walls therebetween. The pluggable body defines a chamber extending along a longitudinal axis between a cable end and a mating end opposite the cable end. The pluggable module includes a latch held by the pluggable body. The latch has an actuation end and a latching end opposite the actuation end. The actuation end has a handle and the latching end has a latching tooth configured to latchably secure the pluggable module to a component when the latching tooth is in a latching position. The actuation end is movable in a linear actuation direction to move the latching tooth in a linear releasing direction perpendicular to the actuation direction from the latching position to a released position.

20 Claims, 4 Drawing Sheets

(56) References Cited

U.S. PATENT DOCUMENTS 8,157,580 B2 * 4/2012 Wu ..... H01R 13/5825 439/352
8,159,783 B2 5/2012 Phillips et al.
8,231,400 B2 * 7/2012 Phillips ..... G02B 6/4201 439/357
8,337,234 B2 12/2012 Sasaki et al.
8,475,199 B2 * 7/2013 Wang ..... H01R 13/6275 439/160
8,500,470 B2 * 8/2013 Wang ..... G02B 6/4261 385/53
8,668,515 B2 * 3/2014 Wu ..... H01R 13/633 439/352
8,740,637 B2 * 6/2014 Wang ..... H01R 13/6335 439/352
8,905,777 B2 * 12/2014 Zhu ..... H01R 13/62 439/352
2007/0243749 A1 * 10/2007 Wu ..... H01R 13/6584 439/352
2008/0032541 A1 * 2/2008 Reed ..... H01R 13/6275 439/352
2009/0209125 A1 * 8/2009 Bright ..... H01R 13/6275 439/352
2010/0317218 A1 * 12/2010 Wu ..... H01R 13/6275 439/352
2011/0275236 A1 * 11/2011 Zhu ..... G02B 6/4292 439/352
2011/0294334 A1 * 12/2011 Phillips ..... G02B 6/4201 439/357
2012/0052712 A1 * 3/2012 Wang ..... H01R 13/6335 439/352
2012/0218720 A1 * 8/2012 Wu ..... H01R 13/6275 361/740
2012/0329305 A1 * 12/2012 Ritter ..... H01R 13/6335 439/350
2014/0193993 A1 * 7/2014 Meng ..... H01R 13/633 439/352
2015/0162709 A1 * 6/2015 Shen ..... H01R 13/6272 439/352
2015/0249304 A1 * 9/2015 Henry ..... H01R 13/6275 439/372
2016/0093978 A1 * 3/2016 Phillips ..... H01R 13/62905 439/310

* cited by examiner

PLUGGABLE MODULE HAVING A LATCH

BACKGROUND OF THE INVENTION

The subject matter herein relates generally to pluggable modules having latches.

At least some known communication systems include receptacle assemblies, such as input/output (I/O) connector assemblies, that are configured to receive a pluggable module and establish a communicative connection between the pluggable module and an electrical communication connector of the receptacle assembly. As one example, a known receptacle assembly includes a cage member that is mounted to a circuit board and configured to receive a small form-factor pluggable (SFP) transceiver in an elongated cavity of the cage member. The pluggable module and the electrical connector have respective electrical contacts that engage one another to establish a communicative connection.

To retain the pluggable module in the cage member, the pluggable modules typically include a latch configured to engage the cage member. The latch is released by pushing downward on a handle or pulling a handle, such as using a tether. Conventional latches are not without disadvantages. For instance, some known latches include multiple components required to be assembled, which may be difficult or time consuming to assemble. Some known latches pivot about a pivot point to release the latch. The releasing direction of the latch is typically perpendicular to the pulling direction used to release the latch. Such pivoting latches ineffectively convert the pulling tension into latch disengagement.

A need remains for a one-piece latch that efficiently converts tension in one direction to unlatching movement of the latch from the cage member in an orthogonal direction.

BRIEF DESCRIPTION OF THE INVENTION

In one embodiment, a pluggable module is provided including a pluggable body having a top wall, a bottom wall and side walls therebetween. The pluggable body defines a chamber extending along a longitudinal axis between a cable end and a mating end opposite the cable end. The pluggable module includes a latch held by the pluggable body. The latch has an actuation end and a latching end opposite the actuation end. The actuation end has a handle and the latching end has a latching tooth configured to latchably secure the pluggable module to a component when the latching tooth is in a latching position. The actuation end is moveable in a linear actuation direction to move the latching tooth in a linear releasing direction perpendicular to the actuation direction from the latching position to a released position.

In another embodiment, a pluggable module is provided including a pluggable body having a top wall, a bottom wall and side walls therebetween. The pluggable body defines a chamber extending along a longitudinal axis between a cable end and a mating end opposite the cable end. The pluggable module includes a latch held by the pluggable body. The latch has a handle exposed forward of the cable end for actuation and a beam extending rearward from the handle into the chamber. The latch has a pulling arm extending from the beam, a lifting arm extending from the pulling arm, and a tooth arm extending from the lifting arm. The latch has a latching tooth at a bottom end of the tooth arm configured to latchably secure the pluggable module to a component when the latching tooth is in a latching position. The latch is actuated to move the latching tooth to a release position. As the handle is pulled forward, the handle pulls the beam and the pulling arm forward. The pulling arm then pulls the lifting arm forward causing the lifting arm to lift upward. The lifting arm then lifts the tooth arm and the latching tooth upward to the released position.

In a further embodiment, a pluggable module is provided that is configured to be mated with a communication connector of a receptacle assembly. The pluggable module includes a pluggable body having a chamber holding a circuit board. The pluggable body extends along a longitudinal axis between a cable end and a mating end opposite the cable end. The circuit board is exposed at the mating end for mating engagement with the communication connector. A latch is held by the pluggable body. The latch extends from the cable end for actuation and extends into the chamber. The latch has a latching tooth configured to secure the pluggable module in the receptacle assembly. The latch is pulled in an actuation direction to move the latching tooth in a releasing direction perpendicular to the actuation direction.

DETAILED DESCRIPTION OF THE INVENTION

Figure 1:
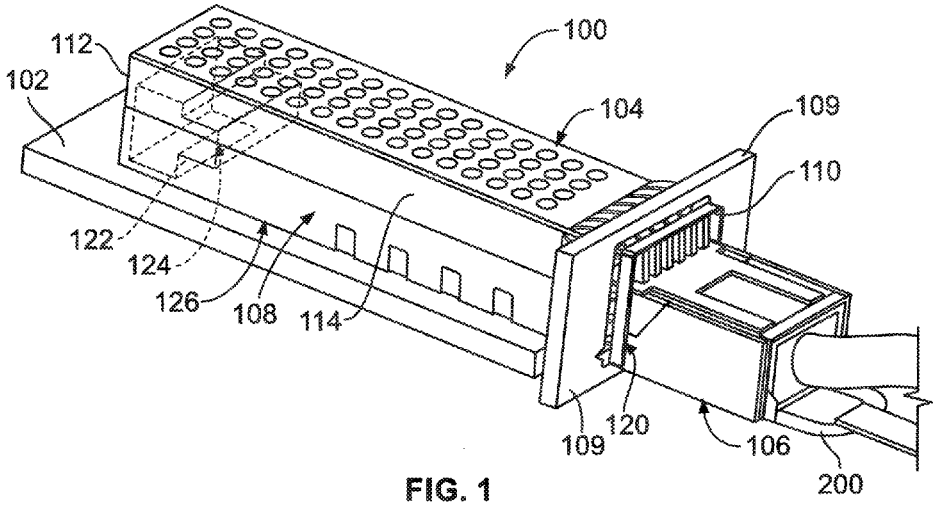
FIG. 1 is a front perspective view of a communication system having a pluggable module having a latch in accordance with an embodiment.

FIG. 1 is a front perspective view of a communication system 100 in accordance with an embodiment. The communication system 100 includes a circuit board 102, a receptacle assembly 104 mounted to the circuit board 102, and one or more pluggable modules 106 that are configured to communicatively engage the receptacle assembly 104. The communication system 100 may be part of or used with telecommunication systems or devices. For example, the communication system 100 may be part of or include a switch, router, server, hub, network interface card, or storage system. The circuit board 102 may be a daughter card or a motherboard and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate 109 of a chassis of the system or device, such as through an opening in the faceplate. As such, the receptacle housing 108 is interior of the device and corresponding faceplate and the pluggable module(s) 106 is loaded into the receptacle housing 108 from outside or exterior of the device and corresponding faceplate. Optionally, the receptacle assembly 104 may be provided with heat exchangers for dissipating heat from the pluggable modules 106.

In the illustrated embodiment, the receptacle assembly 104 is illustrated as a single port receptacle assembly configured to receive a single pluggable module 106; however, the receptacle assembly 104 may be a multi-port receptacle assembly in other embodiments configured to receive pluggable modules 106 in multiple ports. For example, the multiple ports of the receptacle assembly 104 may be ganged side-by-side and/or stacked in addition to, or alternative to, ganged ports.

The receptacle housing 108 includes a front end 110 and an opposite back end 112. The front end 110 may be provided at, and extend through an opening in, the faceplate 109. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104. In other examples, the top and bottom may be referenced to the circuit board 102 with the bottom positioned closer to the circuit board and the top positioned further from the circuit board. The top may be positioned below the bottom in some orientations. The top and the bottom may be horizontally aligned in other orientations, such as when the circuit board 102 is oriented vertically as opposed to horizontally.

The receptacle housing 108 is configured to contain or block electromagnetic interference (EMI) and guide the pluggable module(s) 106 during a mating operation. To this end, the receptacle housing 108 includes a plurality of housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. For example, airflow openings may be provided in the housing walls 114 to allow airflow through the receptacle housing 108. The air may flow from inside the receptacle housing 108 to the external environment or from outside the receptacle housing 108 into the interior of the receptacle housing 108. Fans or other air moving devices may be used to increase airflow through the receptacle housing 108 and over the pluggable module(s) 106.

The receptacle housing 108 defines a module cavity 120 extending between the front and back ends 110, 112. The module cavity 120 receives the pluggable module 106. The housing walls 114 surround and provide shielding for the module cavity 120 and the corresponding pluggable module (s) 106. The module cavity 120 extends lengthwise in a direction that is parallel to the plugging axis of the pluggable module 106. For a multi-port receptacle assembly 104, multiple module cavities 120 or ports are defined for receiving multiple pluggable modules 106. In such embodiments, the module cavities 120 may be stacked vertically and/or ganged horizontally.

The receptacle assembly 104 includes a communication connector 122 (shown in phantom in FIG. 1) having a mating interface 124 for mating with the pluggable module 106. The communication connector 122 may have multiple mating interfaces when configured to mate with multiple pluggable modules 106, such as when used in a stacked cage member. The communication connector 122 is disposed at the back end of the module cavity 120. In an exemplary embodiment, the communication connector 122 is provided at or near the back end 112 of the receptacle housing 108. The communication connector 122 includes electrical contacts (not shown) that are configured to be mated with the pluggable module 106. The communication connector 122 is configured to be mounted to the circuit board 102. The communication connector 122 is configured to be received in the receptacle housing 108 through a bottom 126 of the receptacle housing 108. For example, the receptacle housing 108 is configured to be mounted to the circuit board 102 over the communication connector 122 such that the communication connector 122 passes through an opening in the bottom 126 as the receptacle housing 108 is mounted to the circuit board 102.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

The pluggable module 106 includes a latch 200 for securing the pluggable module in the receptacle housing 108. The latch 200 is releasable, such as by pulling on the latch 200 to release the latch from the receptacle housing 108. The latch 200 may include a tether or other component for actuating the latch 200.

Figure 2:
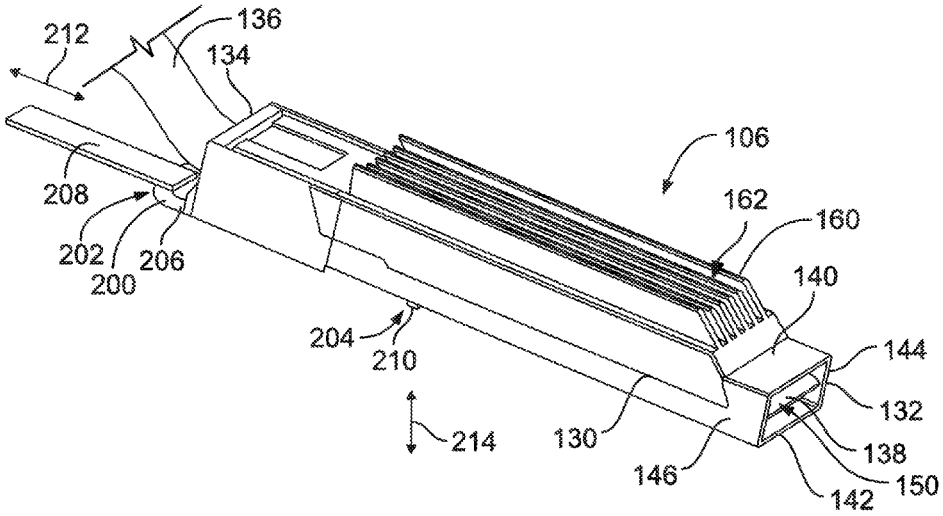
FIG. 2 is a rear perspective view of the pluggable module in accordance with an exemplary embodiment.

FIG. 2 is a rear perspective view of the pluggable module 106 in accordance with an exemplary embodiment. The pluggable module 106 has a pluggable body 130 extending between a mating end 132 at a back of the pluggable module and an opposite cable end 134 at a front of the pluggable module 106. A cable 136 extends from the pluggable body 130 at the cable end 134. The pluggable body 130 also includes an internal circuit board 138 that is communicatively coupled to electrical wires or optical fibers (not shown) of the cable 136. The internal circuit board 138 includes contact pads at the mating end 132 configured to be mated with the communication connector 122 (shown in FIG. 1). The mating end 132 is configured to be inserted into the module cavity 120 (shown in FIG. 1) of the receptacle housing 108 and advanced in a mating direction to mate with the communication connector 122. In an exemplary embodiment, the pluggable body 130 provides heat transfer for the internal circuit board 138, such as for the electronic components on the internal circuit board 138. For example, the internal circuit board 138 is in thermal communication with the pluggable body 130 and the pluggable body 130 transfers heat from the internal circuit board 138.

The pluggable module 106 is illustrated as a finned pluggable module providing heat dissipating fins for increased heat transfer and cooling of the pluggable module 106; however, other types of pluggable modules 106 may be provided in alternative embodiments. The pluggable body 130 has a first wall or top wall 140 and an opposite second wall or bottom wall 142 with side walls 144, 146 extending between the top and bottom walls 140, 142. The top and bottom walls 140, 142 and the sidewalls 144, 146 extend lengthwise along a length of the pluggable body 130 between the mating end 132 and the cable end 134. The top wall 140, bottom wall 142 and sidewalls 144, 146 define a chamber 150 that holds the internal circuit board 138. The cable 136 may extend into the chamber 150 for connection with the internal circuit board 138. Optionally, the internal circuit board 138 may be exposed at the mating end 132 for mating with the corresponding communication connector 122 (shown in FIG. 1).

In an exemplary embodiment, the pluggable body 130 includes a plurality of heat transfer fins 160 extending therefrom. The heat transfer fins 160 increase the surface area of the pluggable body 130 and allow greater heat transfer from the pluggable body 130. The heat transfer fins 160 may extend from any portion of the pluggable body 130, such as from the top wall 140. The heat transfer fins 160 run lengthwise at least partially between the cable end 134 and the mating end 132. Optionally, the heat transfer fins 160 may run substantially the entire length from the cable end 134 to the mating end 132. In the illustrated embodiment, the heat transfer fins 160 are parallel plates that extend continuously between opposite ends of the heat transfer fins 160. The heat transfer fins 160 are separated by channels 162. Optionally, the channels 162 may have a uniform spacing between the heat transfer fins 160. For example, sides of the heat transfer fins 160 may be planar and parallel.

The latch 200 is held by the pluggable body 130. The latch 200 extends from the cable end 134 forward of the pluggable body 130. The latch 200 extends into the chamber 150 such that a portion of the latch 200 is interior of the pluggable body 130 and a portion of the latch 200 is exterior of the pluggable body 130. The latch 200 has an actuation end 202 and a latching end 204 opposite the actuation end 202. The actuation end 202 has a handle 206 configured to be pulled to release the latch 200. In an exemplary embodiment, a tether 208 is coupled to the handle 206 and provides a pulling feature for a user to actuate the latch 200. The latching end 204 has at least one latching tooth 210 (in an exemplary embodiment, the latch 200 includes two latching teeth 210) configured to latchably secure the pluggable module 106 to a component, such as one of the housing walls 114 (shown in FIG. 1) of the receptacle housing 108 (for example, at the bottom 126). The latching tooth 210 is movable between a latching position and a released position. For example, actuation of the latch 200 causes the latching tooth 210 to lift upward from the latching position to the released position. In an exemplary embodiment, the actuation end 202 is movable in a linear actuation direction 212 to move the latching tooth 210 in a linear releasing direction 214 perpendicular to the actuation direction 212 from the latching position to the released position.

Figure 3:
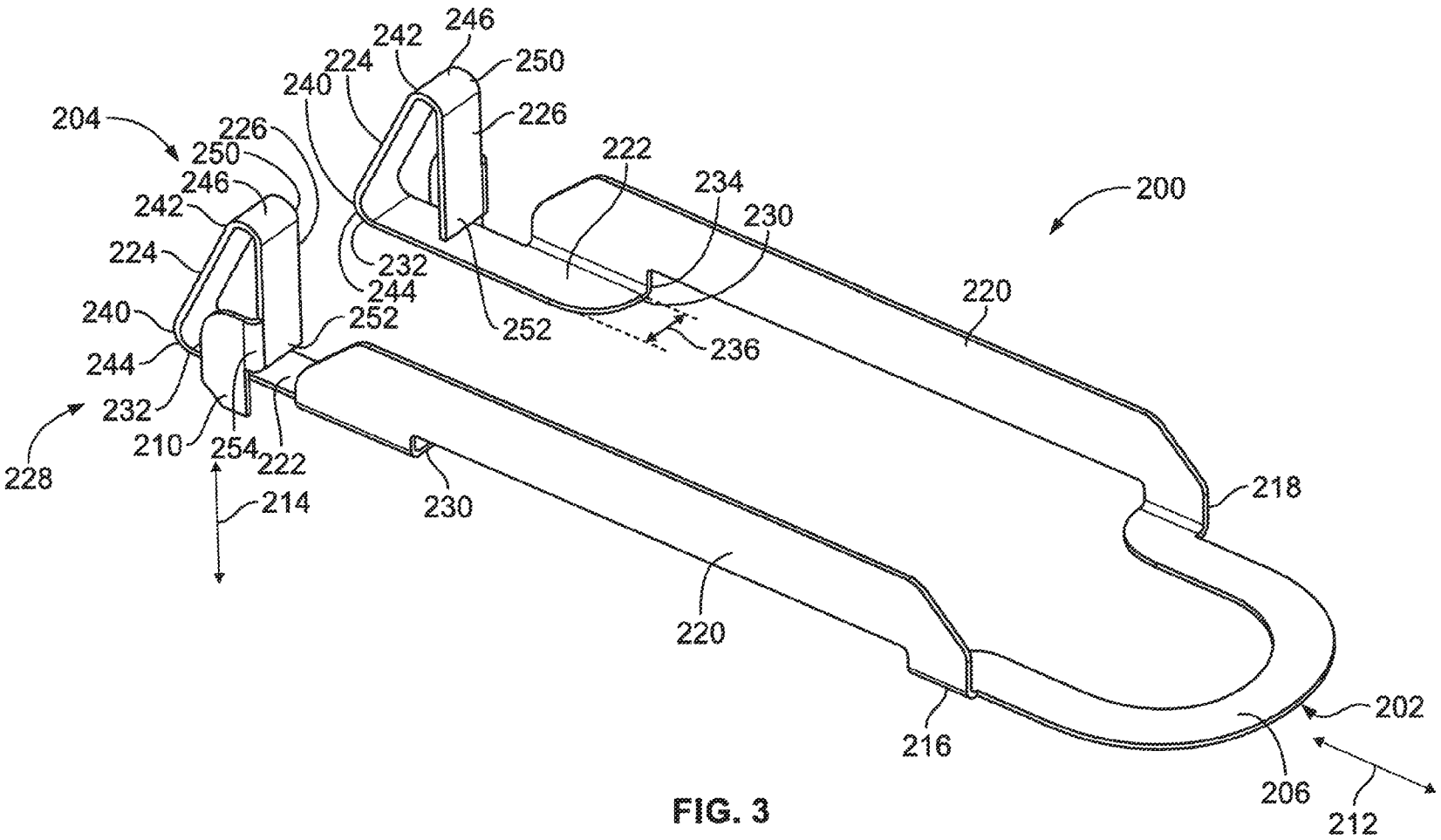
FIG. 3 is a front perspective view of the latch in accordance with an exemplary embodiment.

FIG. 3 is a front perspective view of the latch 200 in accordance with an exemplary embodiment. In the illustrated embodiment, the latch 200 is a unitary one-piece structure including the handle 206 and two latching teeth 210 at the latching end 204. The latch 200 is stamped and formed from a stock piece of metal and formed into a predetermined shape including the handle 206 and the latching teeth 210. The handle 206 is shown as being U-shaped; however, other shapes are possible in alternative embodiments. For example, the handle 206 may extend straight across at the actuation end 202 rather than having the curved U-shape. The handle 206 extends between a first side 216 and a second side 218 of the latch 200. The latching teeth 210 are provided at both sides 216, 218.

Optionally, both sides 216, 218 of the latch 200 may be mirrored-halves of the latch 200. Each side 216, 218 includes a beam 220 extending rearward from the handle 206 to the latching end 204. Optionally, the beam 220 may be bent or folded, such as upward, relative to the handle 206. For example, the handle 206 may oriented generally horizontally while the beam 220 may be oriented generally vertically. The beam 220 may be provided at the outside of the latch 200. The beam 220 may have other shapes or orientations in alternative embodiments.

In an exemplary embodiment, the latch 200 includes a pulling arm 222 extending from the beam 220, a lifting arm 224 extending from the pulling arm 222, and a tooth arm 226 extending from the lifting arm 224. The latching tooth 210 extends from the tooth arm 226. The arms 222, 224, 226 are oriented in different orientations relative to each other. The arms 222, 224, 226 transfer linear movement of the handle 206 in the actuation direction 212 to linear movement of the latching tooth 210 in the releasing directions 214 generally perpendicular to the actuation direction 212. The arms 222, 224, 226 cooperate to define a releasing mechanism 228 for the latching tooth 210. The releasing mechanism 228 is triggered by actuation of the handle 206 to release the latching tooth 210. The releasing mechanism 228 may be used to automatically return the latching tooth 210 to the latching position when the handle 206 is released. For example, when compressed, the releasing mechanism 228 may have an internal spring force to return the latching tooth 210 to the latching position.

The pulling arm 222 extends between a front end 230 and a rear end 232. The front end 230 is connected to the beam 220, such as at a fold 234. Optionally, the pulling arm 222 may be a part of, or an extension of, the beam 220 and/or the handle 206. For example, the latch 200 may be a continuous structure from the handle 206 through the beam 220 and through the pulling arm 222. However, in the illustrated embodiment, the beam 220 is oriented perpendicular to the pulling arm 222. Optionally, the pulling arm 222 may be coplanar with the handle 206. For example, both the handle 206 and the pulling arm 222 are arranged in a pulling arm plane 236. The beam 220, in the illustrated embodiment, is located above the pulling arm plane 236; however, the beam 220 may be below the pulling arm plane 236, may lie entirely within the pulling arm plane 236, or may pass through the pulling arm plane 236 such that a portion of the beam 220 is above the pulling arm plane 236 and a portion of the beam 220 is below the pulling arm plane 236. In other various embodiments, the handle 206 may be above or below the pulling arm plane 236 rather than being coplanar with the pulling arm 222. In an exemplary embodiment, the pulling arm 222 is oriented generally parallel to the actuation direction 212, such that the pulling arm 222 and the handle 206 may be pulled in parallel directions.

The lifting arm 224 extends between a first end 240 and a second end 242. The first end 240 is connected to the rear end 232 of the pulling arm 222 at a first corner 244. The latch 200 is bent at the first corner 244 such that the lifting arm 224 is angled relative to the pulling arm 222. In an exemplary embodiment, the lifting arm 224 is angled at an acute angle relative to the pulling arm 222. The lifting arm 224 is neither parallel to nor perpendicular to the pulling arm 222 when the latching arm 210 is in the latching position. The second end 242 of the lifting arm 224 is connected to the tooth arm 226 at a second corner 246. The latch 200 is bent at the second corner such that the lifting arm 224 is angled relative to the tooth arm 226. Optionally, the corners 244, 246 are curved, having a radius of curvature that accommodates elastic deformation when actuated.

The tooth arm 226 extends between a top end 250 and a bottom end 252. The top end 250 is connected to the second end 242 of the lifting arm 224 at the second corner 246. The latching tooth 210 extends from the bottom end 252, such as below the tooth arm 226. Optionally, the latching tooth 210 may be connected to the tooth arm 226 at a fold 254 at the bottom end 252. As such, the latching tooth 210 is out of plane with respect to the tooth arm 226. For example, in the illustrated embodiment, the latching tooth 210 is folded approximately 90° to pass along the outside of the releasing mechanism 228. As such, the latching tooth 210 may extend from above the pulling arm 222 to a position below the pulling arm 222.

In an exemplary embodiment, the pulling arm 222 extends rearward to the lifting arm 224 and then the lifting arm 224 is angled forward from the first end 240 such that the lifting arm 224 extends over the top of the pulling arm 222. The tooth arm 226 extends downward from the second end 242 toward the pulling arm 222. The bottom end 252 is positioned above the pulling arm 222. In an exemplary embodiment, the tooth arm 226 is oriented generally perpendicular to the pulling arm 222. For example, the pulling arm 222 may be oriented horizontally while the tooth arm 226 may be oriented generally vertically.

During actuation, the pulling arm 222 may be confined to linear movement in the horizontal direction while the tooth arm 226 may be confined to movement in the vertical direction. The lifting arm 224 changes relative positions between the pulling arm 222 and the tooth arm 226 to release the latching tooth 210. In an exemplary embodiment, the releasing mechanism 228 defined by the arms 222, 224, 226 is in the shape of a right triangle when the releasing mechanism 228 is in a relaxed position, and the latching tooth 210 extends therefrom (for example, forming a figure-four shape).

Figure 4:
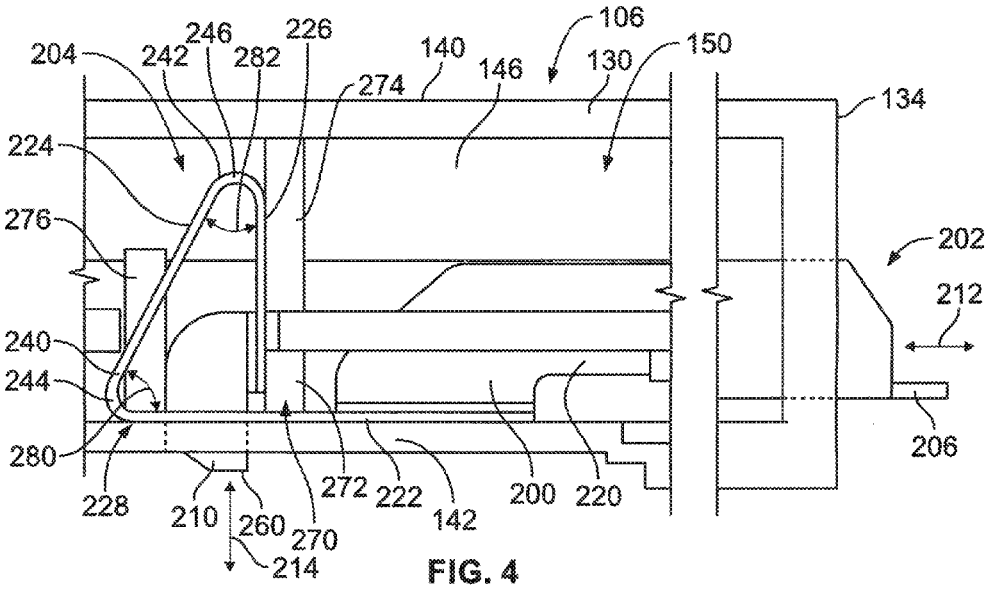
FIG. 4 is a sectional view of a portion of the pluggable module showing the latch in a latched position.
Figure 5:
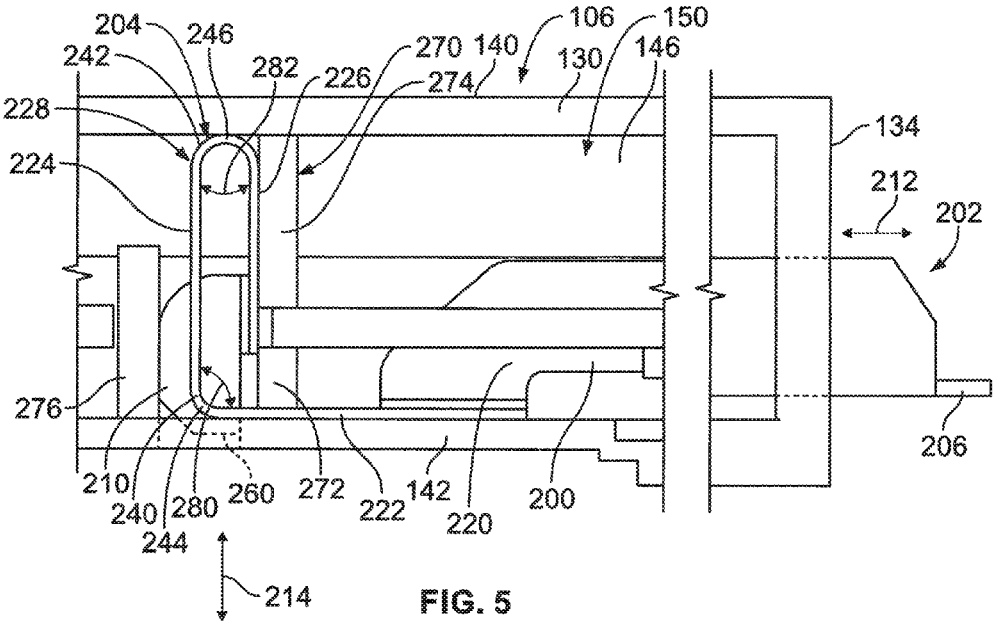
FIG. 5 is a sectional view of a portion of the pluggable module showing the latch in an unlatched position.
Figure 6:
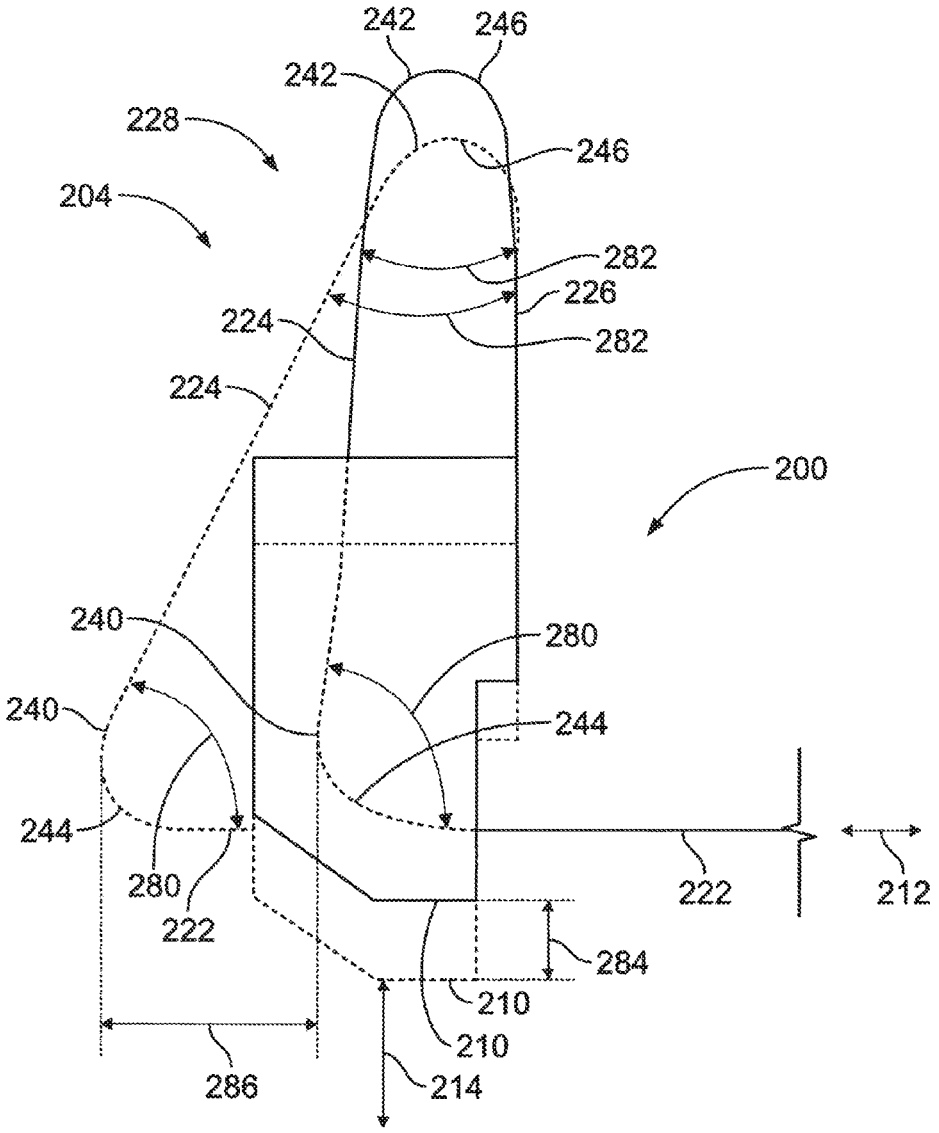
FIG. 6 illustrates a portion of the latch superimposing a releasing mechanism and latching tooth thereof in latching and released positions.

FIG. 4 is a sectional view of a portion of the pluggable module 106 showing the latch 200 in a latched position. FIG. 5 is a sectional view of a portion of the pluggable module 106 showing the latch 200 in an unlatched position. FIG. 6 illustrates a portion of the latch 200 superimposing the releasing mechanism 228 and the latching tooth 210 in the latching position and the released position.

During use, the latch 200 is actuated by pulling the handle 206 (shown in FIG. 3) in the linear actuation direction 212 to cause the latching tooth 210 to move in the linear releasing direction 214 perpendicular to the actuation direction 212 from the latching position to the released position. When the latching tooth 210 is in the latching position (FIG. 4), the pluggable module 106 may be latched to another component, such as the receptacle housing 108 (shown in FIG. 1). When the latching tooth 210 is in the released position (FIG. 5), the pluggable module 106 may be unlatched from the other component, such as for removal of the pluggable module 106 from the receptacle housing 108.

The latch 200 is received in the pluggable body 130 such that the latching end 204 is located within the chamber 150. In an exemplary embodiment, the tooth arm 226 is positioned between the lifting arm 224 and the cable end 134 of the pluggable body 130. The beam 220 passes along and may abut against an interior of the sidewall 146 of the pluggable body 130. The pulling arm 222 may pass along and rest on an interior of the bottom wall 142. The latching tooth 210 may pass along and abut against the interior of the sidewall 146 and may pass through the bottom wall 142, such as through an opening in the bottom wall 142. As such, a latching tip 260 of the latching tooth 210 may be exposed below the bottom wall 142 for latching to the receptacle housing 108.

In an exemplary embodiment, the pluggable body 130 includes positioning features 270 for positioning the latch 200 within the pluggable body 130. For example, portions of the latch 200 may engage the positioning feature 270 to position the latch 200 in the pluggable body 130. Portions of the latch 200 may be confined between various positioning features 270 and/or between positioning features 270 and walls of the pluggable body 130.

In an exemplary embodiment, the pulling arm 222 is confined to linear movement in the actuation direction 212 by the bottom wall 142 and by an upper positioning feature 272. For example, the upper positioning feature 272 may be positioned above the pulling arm 222 while the interior surface of the bottom wall 142 is below the pulling arm 222 to restrict vertical movements of the puling arm 222 and thus confine the pulling arm 222 to horizontal movements in the actuation direction 212.

In an exemplary embodiment, the tooth arm 226 and/or the latching tooth 210 are confined to linear movement in the releasing direction 214. For example, in the illustrated embodiment, the tooth arm 226 engages a front positioning feature 274 and the latching tooth 210 engages a rear positioning feature 276. The tooth arm 226 and the latching tooth 210 are confined between the front and rear positioning features 274, 276. The tooth arm 226 and the latching tooth 210 are only allowed to move vertically within the space defined between the front and rear positioning features 274, 276.

During use, as the handle 206 is pulled forward, the handle 206 pulls the beam 220 and the pulling arm 222 forward in the actuation direction 212. The pulling arm 222 then pulls the lifting arm 224 forward causing the top of the lifting arm 224 to lift upward. For example, as the first end 240 of the lifting arm 224 is pulled forward, the second end 242 of the lifting arm 224 is forced upward. Because the pulling arm 222 is confined to horizontal movement, the first end 240 of the lifting arm 224 is confined against the bottom wall 142. Forward movement of the first end 240 of the lifting arm 224 forces the second end 242 to lift upward. The tooth arm 226 connected to the second end 242 of the lifting arm 224 is similarly lifted upward. As such, the lifting arm 224 lifts both the tooth arm 226 and the latching tooth 210 upward to the released position.

The lifting arm 224 is angled between the pulling arm 222 and the tooth arm 226. As the actuation end 202 is moved in the actuation direction 212, an angle 280 between the lifting arm 224 and the pulling arm 222 increases. The radius of curvature of the first corner 244 may change. An angle 282 between the lifting arm 224 and the tooth arm 226 decreases. The radius of curvature of the second corner 246 may change. The first end 240 of the lifting arm 224 is moved closer to the tooth arm 226 as the actuation end 202 is moved in the actuation direction 212. The lifting arm 224 is moved closer to parallel relative to the tooth arm 226 as the pulling arm 222 is pulled forward (and may be moved parallel or beyond parallel). When the latch 200 is in the unlatched position, the lifting arm 224 may be generally parallel to and spaced apart from the tooth arm 226 with the second corner 246 spanning between the lifting arm 224 and the tooth arm 226. As the lifting arm 224 is pulled forward, the second end 242 is moved away from the pulling arm 222, and a height or distance of the second corner 246 relative to the pulling arm 222 is increased. As the pulling arm 222 is pulled forward, the first end 240 is moved toward the cable end 134 of the pluggable body 130 and the second end 242 is moved toward the top wall 140 of the pluggable body 130. The second end 242 lifts the tooth arm 226 and the latching tooth 210 to the released position. When the releasing mechanism 228 is pulled to the released position, the metal is deformed at the corners 244, 246 creating an internal spring force within the releasing mechanism 228. When the handle 206 is released, the releasing mechanism 228 automatically springs back or returns to the latching position.

The angle 280 between the lifting arm 224 and the pulling arm 222 affects a lifting distance 284 that the latching tooth 210 is moved between the latching position and the released position. For example, based on the angle of the lifting arm 224, the lifting distance 284 may be less than a pulling distance 286. For example, a pulling distance of approximately 2 millimeters may convert to a lifting distance 284 of approximately 1 millimeter; however, other distances are possible in alternative embodiments by changing the angle of the lifting arm.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A pluggable module comprising:

a pluggable body having a top wall, a bottom wall and side walls therebetween, the pluggable body defining a chamber extending along a longitudinal axis between a cable end and a mating end opposite the cable end; and a latch held by the pluggable body, the latch having an actuation end and a latching end opposite the actuation end, the actuation end having a handle, the latching end having a latching tooth configured to latchably secure the pluggable module to a component when the latching tooth is in a latching position, the latch including a pulling arm operably connected to the handle, a lifting arm extending from the pulling arm, and a tooth arm extending from the lifting arm, the latching tooth being provided at a bottom end of the tooth arm, the pulling arm, the lifting arm and the tooth arm being an integral unitary structure, the actuation end being actuated to move the pulling arm in a linear actuation direction to move the tooth arm and the latching tooth in a linear releasing direction perpendicular to the actuation direction from the latching position to a released position.

2. The pluggable module of claim 1, wherein the latching tooth is confined to movement in the releasing direction.

3. The pluggable module of claim 1, wherein the actuation direction is horizontal and the releasing direction is vertical.

4. The pluggable module of claim 1, wherein the latching tooth extends from a tooth arm oriented perpendicular to the actuation direction.

5. The pluggable module of claim 1, wherein, as the handle is pulled forward, the handle pulls the pulling arm forward, the pulling arm then pulls the lifting arm forward causing the lifting arm to lift upward, the lifting arm then lifts the tooth arm and the latching tooth upward to the released position.

6. The pluggable module of claim 5, wherein the lifting arm is angled between the pulling arm and the tooth arm.

7. The pluggable module of claim 5, wherein the lifting arm extends between a first end and a second end, the first end being connected to the pulling arm, the second end being connected to the tooth arm, the first end being moved closer to the tooth arm as the actuation end is moved in the actuation direction.

8. The pluggable module of claim 5, wherein the lifting arm extends between a first end and a second end, the first end being connected to the pulling arm, the second end being connected to the tooth arm, the second end being moved away from the pulling arm as the actuation end is moved in the actuation direction.

9. The pluggable module of claim 5, wherein the lifting arm extends between a first end and a second end, the first end being connected to the pulling arm, the second end being connected to the tooth arm, the first end being moved toward the cable end of the pluggable body as the actuation end is moved in the actuation direction, the second end being moved toward the top wall of the pluggable body as the actuation end is moved in the actuation direction.

10. The pluggable module of claim 5, wherein the lifting arm extends between a first end and a second end, the first end meeting the pulling arm at a first corner, the second end meeting the tooth arm at a second corner, the latch being curved at the first corner and at the second corner, an angle of curvature of the first corner increasing as the actuation end is moved in the actuation direction, an angle of curvature of the second corner decreasing as the actuation end is moved in the actuation direction.

11. The pluggable module of claim 5, wherein the lifting arm extends between a first end and a second end, the first end meeting the pulling arm at a first corner, the second end meeting the tooth arm at a second corner, the first corner moving toward the cable end of the pluggable body as the actuation end is moved in the actuation direction, the second corner moving toward the top wall of the pluggable body as the actuation end is moved in the actuation direction.

12. The pluggable module of claim 5, wherein the tooth arm is positioned between the lifting arm and the cable end of the pluggable body.

13. The pluggable module of claim 5, wherein the handle is coplanar with the pulling arm, the latching tooth passing through a pulling arm plane defined by the pulling arm.

14. The pluggable module of claim 1, further comprising a tether coupled to the handle and pulling the handle in the actuation direction.

15. The pluggable module of claim 1, wherein the latching end of the latch forms a release mechanism in the shape of a right triangle with the latching tooth extending therefrom.

16. A pluggable module comprising:

a pluggable body having a top wall, a bottom wall and side walls therebetween, the pluggable body defining a chamber extending along a longitudinal axis between a cable end and a mating end opposite the cable end; and a latch held by the pluggable body, the latch having a handle exposed forward of the cable end for actuation, the latch having a beam extending rearward from the handle into the chamber, the latch having a pulling arm extending from the beam, the latch having a lifting arm extending from the pulling arm, the latch having a tooth arm extending from the lifting arm, the latch having a latching tooth at a bottom end of the tooth arm configured to latchably secure the pluggable module to a component when the latching tooth is in a latching position, the latch being actuated to move the latching tooth to a released position, wherein as the handle is pulled forward, the handle pulls the beam and the pulling arm forward, the pulling arm then pulls the lifting arm forward causing the lifting arm to lift upward, the lifting arm then lifts the tooth arm and the latching tooth upward to the released position.

17. The pluggable module of claim 16, wherein the latching tooth is confined to movement in the releasing direction.

18. The pluggable module of claim 16, wherein the actuation direction is horizontal and the releasing direction is vertical.

19. The pluggable module of claim 16, wherein the lifting arm is angled between the pulling arm and the tooth arm.

20. A pluggable module configured to be mated with a communication connector of a receptacle assembly, the pluggable module comprising:

a pluggable body having a chamber holding a circuit board, the pluggable body extending along a longitudinal axis between a cable end and a mating end opposite the cable end, the circuit board being exposed at the mating end for mating engagement with the communication connector; and a latch held by the pluggable body, the latch extending from the cable end for actuation, the latch extending into the chamber, the latch having a latching tooth configured to secure the pluggable module in the receptacle assembly, the latch being pulled in an actuation direction to move the latching tooth in a releasing direction perpendicular to the actuation direction.

* * * * *